United States Patent [19]

Ford

[11] 4,275,622

[45] Jun. 30, 1981

[54] DUAL WHEEL VALVE STEM TOOL

[76] Inventor: Willie Ford, 3531 S. Ewing, Dallas, Tex. 75216

[21] Appl. No.: 32,765

[22] Filed: Apr. 24, 1979

[51] Int. Cl.[3] ..... B25B 13/00

[52] U.S. Cl. ..... 81/125.1

[58] Field of Search ..... 81/119, 121 R, 121 B, 81/125.1, 177 R

[56] References Cited

U.S. PATENT DOCUMENTS

| | | | |
|---|---|---|---|
| D. 34,213 | 3/1901 | Baxter . | |
| D. 53,620 | 7/1919 | Walton . | |
| D. 59,325 | 10/1921 | Bellows . | |
| 1,053,536 | 2/1913 | Sargent . | |
| 1,310,641 | 7/1919 | Welch | 81/125.1 |
| 1,347,780 | 7/1920 | Jacoby . | |
| 1,440,272 | 12/1922 | Bratton | 81/177 R UX |
| 1,584,208 | 5/1926 | Bellows . | |
| 1,705,470 | 3/1929 | Chirpe . | |
| 2,015,613 | 9/1935 | Baumgarten . | |
| 2,426,763 | 9/1947 | Curtis . | |
| 2,895,364 | 7/1959 | Heinz | 81/121 B X |
| 3,069,945 | 12/1962 | Shandel . | |
| 4,050,334 | 9/1977 | Davis, Jr. . | |

*Primary Examiner*—James G. Smith

*Attorney, Agent, or Firm*—Richards, Harris & Medlock

[57] ABSTRACT

A manual tool (20) comprises a rigid shaft (22) having a straight portion (24) and an arcuate portion (26) joined at about a right angle. Wrenches (28, 30) are secured to the ends of the shaft (22). The tool (20) is particularly adapted for engaging the valve stem retainer nut on the inside wheel of dual wheels without removal of the outside wheel.

7 Claims, 3 Drawing Figures

DUAL WHEEL VALVE STEM TOOL

TECHNICAL FIELD

The present invention relates in general to a manual tool. More particularly, this invention concerns a tool for engaging the retainer nut of a valve stem on the inside wheel of a dual wheel set without removal of the outside wheel.

BACKGROUND ART

Many vehicles on the road today utilize sets of dual wheels. Eighteen wheel semi-trailer rigs have several sets of dual wheels, and most delivery trucks and even some pickup trucks incorporate dual wheels for greater load capability.

Maintenance of proper tire inflation is important to the operation of tired vehicles, and particularly freight and delivery vehicles having a high degree of usage. Valve stems for introducing air into tires are typically mounted in the outside wheel rim, and can be a source of leakage. In automobiles and other light-duty vehicles, the valve stems are usually press fitted into the wheel. In heavier duty vehicles, such as trucks and the like, the valve stems are typically secured to the wheels by retainer nuts. These valve stem retainer nuts can loosen from vibration and road shock, and thus require tightening every so often to maintain a proper seal between the wheel and valve stem. This task has been especially difficult and time consuming for the inside wheel of a dual wheel set because heretofore it has been necessary to first remove the outside wheel. Due to the difficulty of removing outside wheels, valve stem retainer nuts on inside wheels have not been tightened as often as required. There is thus a need for a tool for tightening the valve stem retainer nut on the inside wheel of a dual wheel set without removal of the outside wheel.

DISCLOSURE OF INVENTION

The present invention comprises a manual tool which overcomes the foregoing and other problems associated with the prior art. In accordance with the invention, there is provided a tool which is particularly suited for use by operators of vehicles incorporating dual wheels. The tool of the invention is adapted for tightening the valve stem retainer nut on either wheel in a dual wheel set without removal of the other wheel. That is, the tool herein permits the valve stem retainer nut on the inside wheel to be tightened in place without removal of the outside wheel.

In accordance with more specific aspects of the invention, the present invention comprises a manual tool having a shaft with at least one wrench socket or nut engaging means attached to a shaft. In the preferred embodiment, a wrench box-end or nut engaging means is attached to each end of the shaft in predetermined orientation. The shaft includes a straight portion and an arcuate portion joined together at a predetermined angle. The unique configuration of the tool herein permits extension through the openings in the outside wheel and engagement with the valve stem retainer nut on the inside wheel. Since removal of the outside wheel is not required, use of the present invention results in considerable time savings.

BRIEF DESCRIPTION OF DRAWINGS

A more complete understanding of the invention can be had by referring to the following Detailed Description in conjunction with the accompanying Drawings, wherein.

DETAILED DESCRIPTION

Figure 1:
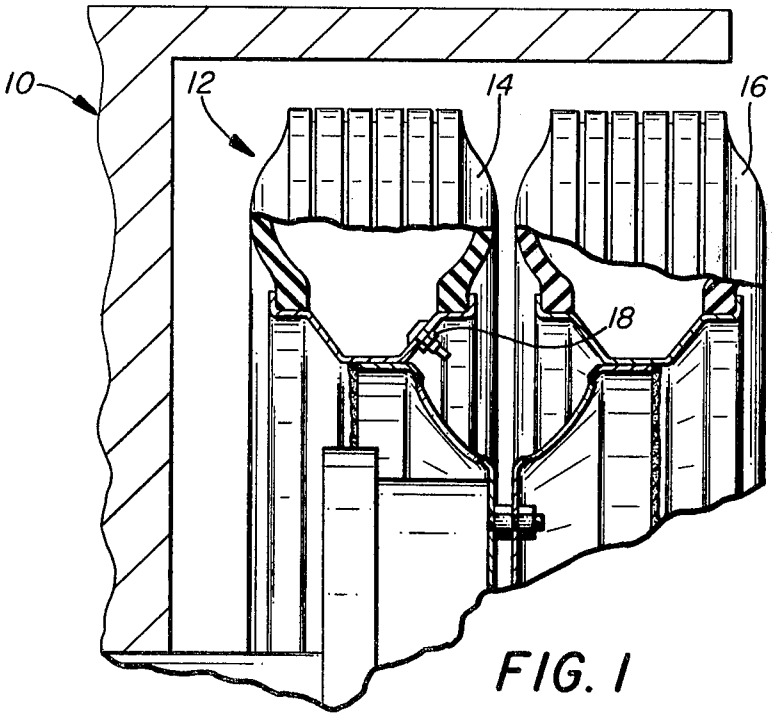
FIG. 1 is an illustration of a vehicle incorporating dual wheels with which the present invention is particularly useful.

Referring now to the Drawings, wherein like reference numerals designate like or corresponding parts throughout the several views, and particularly referring to FIG. 1, there is shown a vehicle 10 incorporating at least one dual wheel set 12. The dual wheel set 12 includes an inside wheel 14 and an outside wheel 16. The inside wheel 14 includes a tire valve stem secured by a retainer nut 18. In the past it has been necessary to remove outside wheel 16 to reach the nut 18 on inside wheel 14. As will be more fully described hereinafter, the tool of the present invention permits tightening of nut 18 without removal of outside wheel 16.

Figure 2:
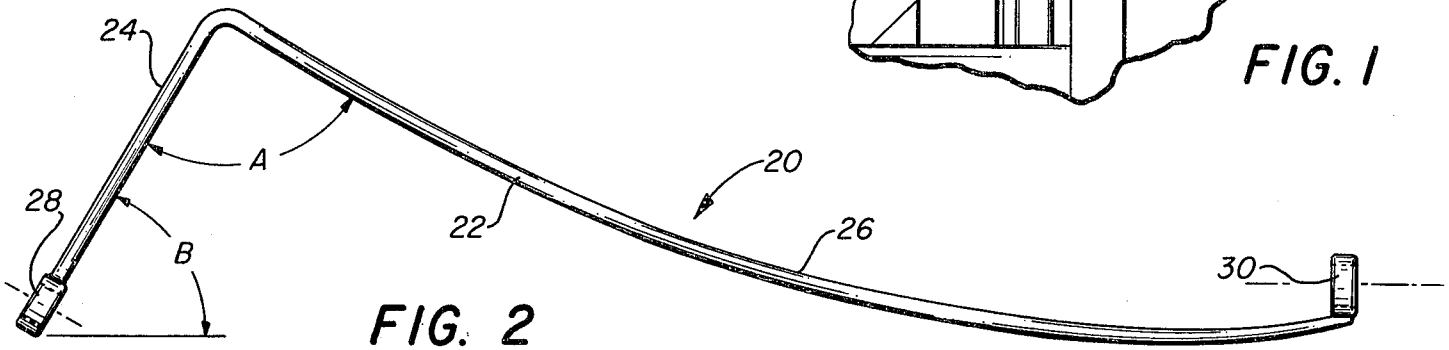
FIG. 2 is a side view of a manual tool incorporating the invention.
Figure 3:
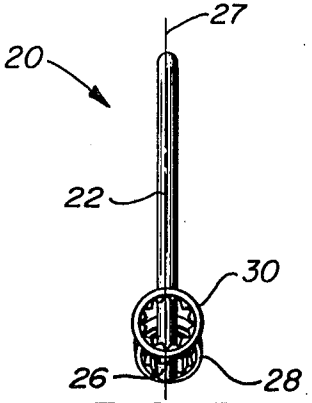
FIG. 3 is an end view of FIG. 2.

The tool 20 of the present invention, and its constructional features, are shown in FIGS. 2 and 3. In the preferred embodiment, the overall length of tool 20 is about 17.5 inches. Tool 20 includes a rigid shaft 22. Shaft 22 can be formed of quarter inch round steel, for example. Shaft 22 comprises a straight and arcuate portions 24 and 26 lying in a common plane 27 shown in FIG. 3. Arcuate portion 26 is relatively longer than straight portion 24. Portion 26 is gently curved. Portions 24 and 26 are joined together at an angle A. In the preferred embodiment of the invention, angle A is approximately 90°. Straight portion 24 is positioned with respect to the horizontal at angle B, which is about 60° in the preferred embodiment.

Wrench sockets, box ends or suitable nut engaging means are secured to the shaft 22 of tool 20. In the preferred embodiment of tool 20, two box-end wrenches 28 and 30 are mounted at opposite ends of shaft 22. Wrench 28 is rigidly secured to shaft 22 at the end of straight portion 24. The longitudinal axis of straight portion 24 lies substantially in the transverse plane of wrench 28. Wrench 30 is rigidly secured to shaft 22 at the end of arcuate portion 26. Preferably, the transverse plane of wrench 30 is positioned at about a right angle to the end of portion 26. The planes of both wrenches 28 and 30 are oriented substantially perpendicular to the plane 27 of shaft 22. The dashed lines extending through wrenches 28 and 30 in FIG. 2 indicate their longitudinal axes. The wrenches 28 and 30 are of predetermined sizes, for example, 9/16 inch twelve-point box-ends.

Although the preferred embodiment of tool 20 utilizes both wrenches 28 and 30, it will be understood that only one nut engaging member is required for engagement with the valve stem retainer nut 18 on inside wheel 14. Tool 20 is manipulated to engage nut 18 with wrench 30. Wrench 28 or 30 can be used to engage the valve stem retainer nut (not shown) on outside wheel 16. Inclusion of wrench 28 is thus optional, although desirable.

From the foregoing, it will be understood that the present invention comprises a manual tool having several advantages over the prior art. The tool herein is particularly suited for tightening the valve stem retainer nut on the inside wheel of dual wheels in place without removing the outside wheel. Use of the tool results in time savings. Other advantages will suggest themselves to those skilled in the art.

Although particular embodiments of the invention have been illustrated in the accompanying Drawing and described in the foregoing Detailed Description, it will be understood that the invention is not limited to the embodiments disclosed, but is intended to embrace any alternatives, modifications, and rearrangements and/or substitutions of parts or elements as fall within the spirit and scope of the invention.

I claim:

1. A manual tool adapted to engage a valve stem retainer nut on the inside wheel of a dual wheelset without removal of the outside wheel, which comprises:

a rigid shaft having two ends;

said shaft including an arcuate portion and a substantially straight portion lying in a common plane and joined at a predetermined angle; and a nut-engaging member rigidly secured to each end of said shaft for engaging the valve stem retainer nut, each member having a longitudinal axis lying in said common plane and extending at a predetermined angle transverse to its corresponding shaft portion;

the nut-engaging member on the end of the straight portion of said shaft having a transverse plane extending therethrough which subtends the straight shaft portion with the longitudinal axis of said member being oriented substantially perpendicular to the straight shaft portion.

2. The manual tool of claim 1, wherein the arcuate portion of said shaft is relatively longer than and curves away from the straight portion of the shaft.

3. The manual tool of claim 1, wherein the arcuate and straight portions of said shaft join together at an angle of about 90°.

4. A manual tool for engaging a valve stem retainer nut, comprising:

a rigid shaft having first and second portions of different lengths joined at a predetermined angle;

said first shaft portion being substantially straight, and said second portion being arcuate;

said first and second shaft portions being substantially coplanar; and first and second wrench elements rigidly secured to opposite ends of said shaft, each wrench element having a longitudinal axis coplanar with said shaft portions and extending transverse to its corresponding shaft portion;

said first wrench element having a transverse plane extending therethrough which subtends the first shaft portion and being secured to the end of the first shaft portion with the longitudinal axis of said element substantially perpendicular therewith, and said second wrench element having a transverse plane extending therethrough and being secured to the end of the second shaft portion with the transverse plane of said element oriented at a predetermined angle with respect thereto.

5. The tool of claim 4, wherein the second shaft portion is relatively longer than and curves away from the first shaft portion.

6. The tool of claim 4, wherein the first and second shaft portions are joined at an angle of about 90°.

7. The tool according to claim 4, wherein said second wrench element is secured to the end of said second shaft portion such that the transverse plane of said element is oriented at about 90° relative to the end of said second shaft portion and such that the longitudinal axis of said element is substantially parallel with the plane of said shaft portions.

* * * * *